US010151151B2

(12) United States Patent
Roper et al.

(10) Patent No.: US 10,151,151 B2
(45) Date of Patent: Dec. 11, 2018

(54) RISER DEFLECTION MITIGATION

(71) Applicant: Ensco International Incorporated, Wilmington, DE (US)

(72) Inventors: Richard Robert Roper, Katy, TX (US); Mason Corey Melkowits, Katy, TX (US)

(73) Assignee: Ensco International Incorporated, Wilmington, DE (US)

( * ) Notice: Subject to any disclaimer, the term of this patent is extended or adjusted under 35 U.S.C. 154(b) by 0 days.

(21) Appl. No.: 15/092,810

(22) Filed: Apr. 7, 2016

(65) Prior Publication Data

US 2016/0298397 A1 Oct. 13, 2016

Related U.S. Application Data

(60) Provisional application No. 62/144,217, filed on Apr. 7, 2015, provisional application No. 62/148,645, filed on Apr. 16, 2015.

(51) Int. Cl.
*E21B 17/01* (2006.01)

(52) U.S. Cl.
CPC ..... *E21B 17/01* (2013.01); *E21B 17/017* (2013.01)

(58) Field of Classification Search
CPC ..... E21B 17/01; E21B 17/017
USPC .... 114/219, 220, 240 R, 241, 240 A, 240 B, 114/240 C, 240 D, 240 E; 405/211, 405/211.1, 212–216, 224.2; 166/367; 254/199–263
See application file for complete search history.

(56) References Cited

U.S. PATENT DOCUMENTS 1,365,490 A * 1/1921 Hartford ..... F42C 14/04 102/412
2,704,652 A * 3/1955 Fisher ..... F16G 11/048 24/909
3,855,656 A * 12/1974 Blenkarn ..... B63B 22/18 114/267
3,983,706 A * 10/1976 Kalinowski ..... B63B 21/502 166/355
4,068,479 A * 1/1978 Lane, Jr. ..... E02B 3/062 114/220
4,102,144 A * 7/1978 Anders ..... B63B 35/10 114/40

(Continued)

FOREIGN PATENT DOCUMENTS

FR 3030667 A1 * 6/2016
GB 2024292 A * 1/1980

(Continued)

OTHER PUBLICATIONS

PCT Application No. PCT/US2016/026429 PCT International Search Report and Written Opinion dated Jul. 18, 2016.

*Primary Examiner* — Sunil Singh
(74) *Attorney, Agent, or Firm* — Fletcher Yoder, P.C.

(57) ABSTRACT

Techniques and systems to reduce deflection of a riser extending from offshore platform. The riser may be coupled to a seafloor and may experience movements due to, for example, currents. A riser restraint device may be utilized to reduce these movements of the riser. This riser restraint device may be coupled to the seafloor. This coupling of the riser restraint device may aid in allowing the riser restraint device to reduce movement of the riser and, thus, reduce deflection of the riser.

15 Claims, 7 Drawing Sheets

(56) References Cited

U.S. PATENT DOCUMENTS

| | | | | |
|---|---|---|---|---|
| 4,818,146 | A * | 4/1989 | Fontenot | E02D 5/80 405/212 |
| 5,224,800 | A * | 7/1993 | Mogridge | B63B 22/025 405/195.1 |
| 6,042,303 | A * | 3/2000 | Head | E21B 17/015 166/359 |
| 6,619,887 | B1 * | 9/2003 | Szewczyk | F15D 1/10 405/211 |
| 7,467,913 | B1 * | 12/2008 | Allen | B63B 35/4413 405/195.1 |
| 2003/0161690 | A1 * | 8/2003 | Breivik | B63B 27/24 405/224.2 |
| 2006/0056918 | A1 | 3/2006 | Luppi | |
| 2006/0140726 | A1 | 6/2006 | Pollack et al. | |
| 2007/0003372 | A1 * | 1/2007 | Allen | E02D 27/52 405/211 |
| 2008/0311804 | A1 | 12/2008 | Bauduin et al. | |
| 2009/0044950 | A1 * | 2/2009 | Boudreau | E21B 17/012 166/350 |
| 2009/0103985 | A1 | 4/2009 | Casola et al. | |
| 2011/0049449 | A1 * | 3/2011 | Scott | B63C 7/20 254/264 |
| 2013/0139415 | A1 | 6/2013 | Halkyard et al. | |

FOREIGN PATENT DOCUMENTS

| | | | |
|---|---|---|---|
| GB | 2061452 A | * | 5/1981 |
| WO | WO 99/66169 | * | 12/1999 |

* cited by examiner

RISER DEFLECTION MITIGATION

This application is a Non-Provisional Application claiming priority to U.S. Provisional Patent Application No. 62/144,217, entitled "RISER DEFLECTION MITIGATION", filed Apr. 7, 2015, which is herein incorporated by reference. This application is a Non-Provisional Application claiming priority to U.S. Provisional Patent Application No. 62/148,645, entitled "RISER DEFLECTION MITIGATION", filed Apr. 16, 2015, which is herein incorporated by reference.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Advances in the petroleum industry have allowed access to oil and gas drilling locations and reservoirs that were previously inaccessible due to technological limitations. For example, technological advances have allowed drilling of offshore wells at increasing water depths and in increasingly harsh environments, permitting oil and gas resource owners to successfully drill for otherwise inaccessible energy resources. To drill for oil and gas offshore, it is desirable to have stable offshore platforms and/or floating vessels from which to drill and recover the energy resources. Techniques to stabilize the offshore platforms and floating vessels include, for example, the use of mooring systems and/or dynamic positioning systems. However, these systems may not always adequately stabilize components descending from the offshore platforms and floating vessels to the seafloor wellhead.

For example, a riser string (e.g., a pipe or series of pipes that connects the offshore platforms or floating vessels to the floor of the sea) may be used to transport drill pipe, casing, drilling mud, production materials or hydrocarbons between the offshore platform or floating vessel and a wellhead. The riser is suspended between the offshore platform or floating vessel and the wellhead, and may experience forces, such as underwater currents, that cause deflection (e.g., bending or movement) in the riser. Acceptable deflection can be measured by the deflection along the riser, and also at, for example, select points along the riser. These points may be located, for example, at the offshore platform or floating vessel and at the wellhead. If the deflection resulting from underwater current is too great, drilling must cease and the drilling location or reservoir may not be accessible due to such technological constraints. Accordingly, it would be desirable to provide techniques to stabilize risers in offshore drilling and energy resource recovery environments.

DETAILED DESCRIPTION

Figure 1:
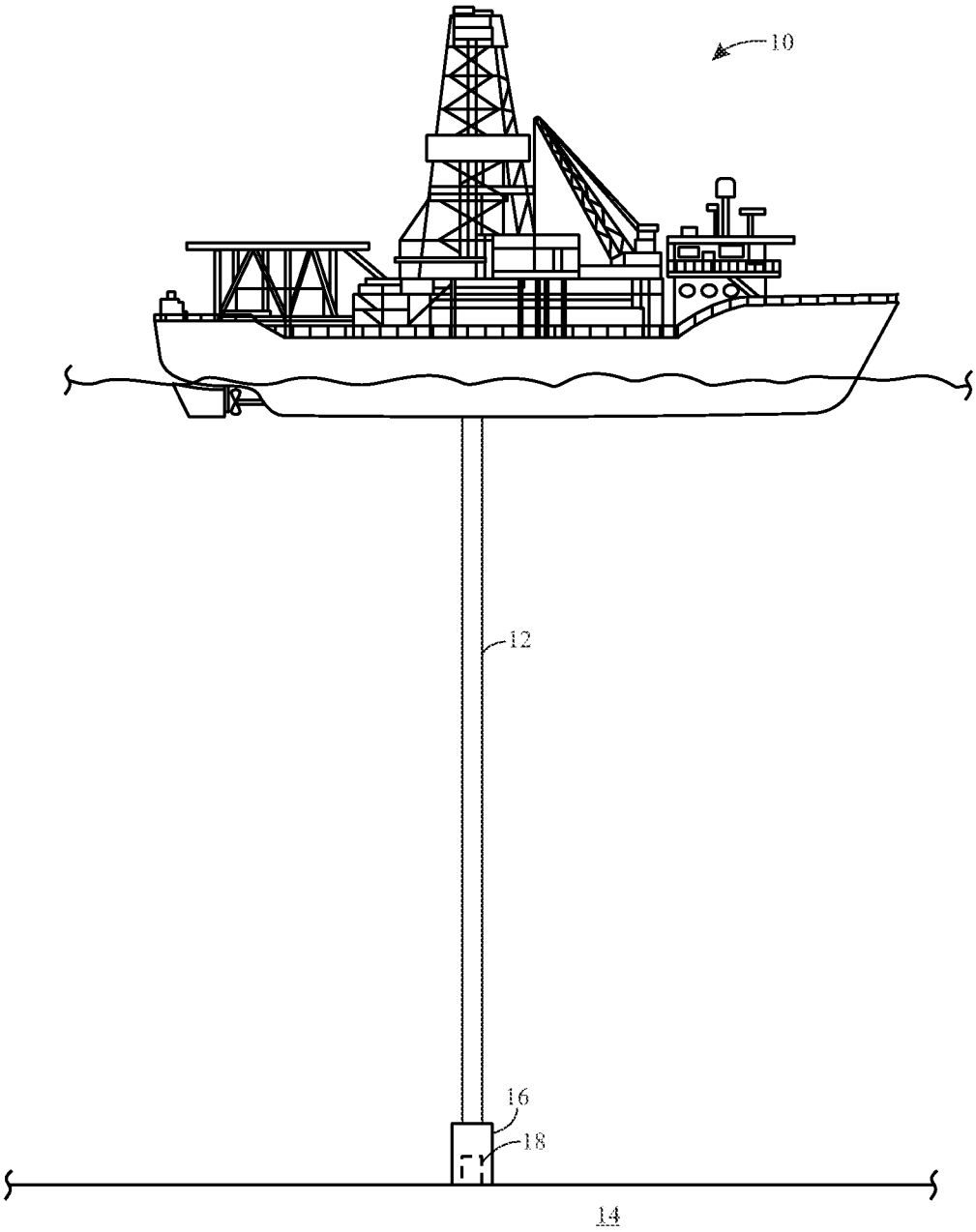
FIG. 1 PRIOR ART
FIG. 1 illustrates an example of an offshore platform having a riser, in accordance with an embodiment.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Systems and techniques for stabilizing a riser (e.g., a riser string) extending from offshore platform, such as a drillship, a semi-submersible platform, a floating production system, or the like, are set forth below. In one embodiment, a submerged buoy is anchored adjacent a drilling location. The buoy serves as an anchor point for tethering the riser, thereby limiting downstream deflections and functioning as a riser restraint device to prevent and/or reduce deflection in the riser. Further, one or more tethers, which may be adjustable and/or releasable, may be coupled between the riser and the buoy, whereby the control (e.g., release and/or adjustment of length) of the one or more tethers may be performed locally and/or remotely. In other embodiments, more than one buoy may be employed with at least one line disposed between at least two buoys. In this embodiment, one or more tethers may be coupled between the at least one line and the riser to serve as an anchor point for the riser.

Additionally and/or alternatively, the riser restraint device may be a ring, cylinder, or similar device that may encircle the riser. In one embodiment, the riser restraint device may be tethered, for example, to the seafloor or equipment installed on the seafloor such as the BOP (blow out preventer), a suction pile or other structure. The riser restraint device may also be connected to a series (e.g., three or more) anchor lines (e.g., mooring lines), which are in turn anchored to the seafloor (e.g., via suction piles or other similar anchors) and may limit deflections of the riser by restraining riser movement related to current flow or other environmental forces (e.g., providing resistance to horizontal movement of the riser as the riser moves into contact with the riser restraint device). One or more tethers (e.g., anchor lines or mooring lines), which may be adjustable and/or releasable, may be coupled between the riser restraint device and the seafloor (or the riser itself), whereby the control (e.g., release and/or adjustment of length) of the one or more tethers may be performed locally and/or remotely. In other embodiments, more than one riser restraint device may be employed, for example, vertically along the length of the riser.

In some embodiments, a flooded ring structure is used as the riser restraint device. The flooded ring structure may be centered over a wellhead and connected to a series (e.g., three or more) anchor lines (e.g., mooring lines), which are in turn anchored to the seafloor (e.g., via suction piles or other similar anchors). Water may be displaced from the flooded ring through introduction of air, nitrogen, and/or other compressed gas. The resultant buoyant ring rises in a water column surrounding the riser until the anchor lines become taught, restraining both vertically and horizontally the ring by the connected anchor lines. In some embodiments, the ring is sized to allow the passage of both a blow out preventer and a riser. With the blow out preventer latched at the wellhead, the riser remains inside the ring. The inner perimeter of the ring may be designed for contact with the riser, and may be contoured to prevent damage to the riser. In some embodiments, horizontal deflection of the riser is restrained by the ring and anchoring system. The ring and anchoring system may incorporate, for example, acoustic releases to facilitate rapid relocation of the rig, riser, and ring in the case of a well control event. Additionally, the capability of acoustic-actuated flooding of the ring may be incorporated.

With the foregoing in mind, FIG. 1 illustrates an offshore platform comprising a drillship 10. Although the presently illustrated embodiment of an offshore platform is a drillship 10 (e.g., a ship equipped with a drill rig and engaged in offshore oil and gas exploration and/or well maintenance or completion work including, but not limited to, casing and tubing installation, subsea tree installations, and well capping), other offshore platforms such as a semi-submersible platform, a floating production system, or the like may be substituted for the drillship 10. Indeed, while the techniques and systems described below are described in conjunction with drillship 10, the stabilization techniques and systems are intended to cover at least the additional offshore platforms described above.

As illustrated in FIG. 1, the drillship 10 includes a riser 12 extending therefrom. The riser 12 may include a pipe or a series of pipes that connect the drillship 10 to the seafloor 14 via, for example, blow out preventer (BOP) 16 that is coupled to a wellhead 18 on the seafloor 14. In some embodiments, the riser 12 may transport produced hydrocarbons and/or production materials between the drillship 10 and the wellhead 18, while the BOP 16 may include at least one valve with a sealing element to control wellbore fluid flows. In some embodiments, the riser 12 may pass through an opening (e.g., a moonpool) in the drillship 10 and may be coupled to drilling equipment of the drillship 10. As illustrated in FIG. 1, it may be desirable to have the riser 12 positioned in a vertical orientation between the wellhead 18 and the drillship 10. However, external factors (e.g., environmental factors such as currents) may disturb the vertical orientation of the riser 12.

Figure 2:
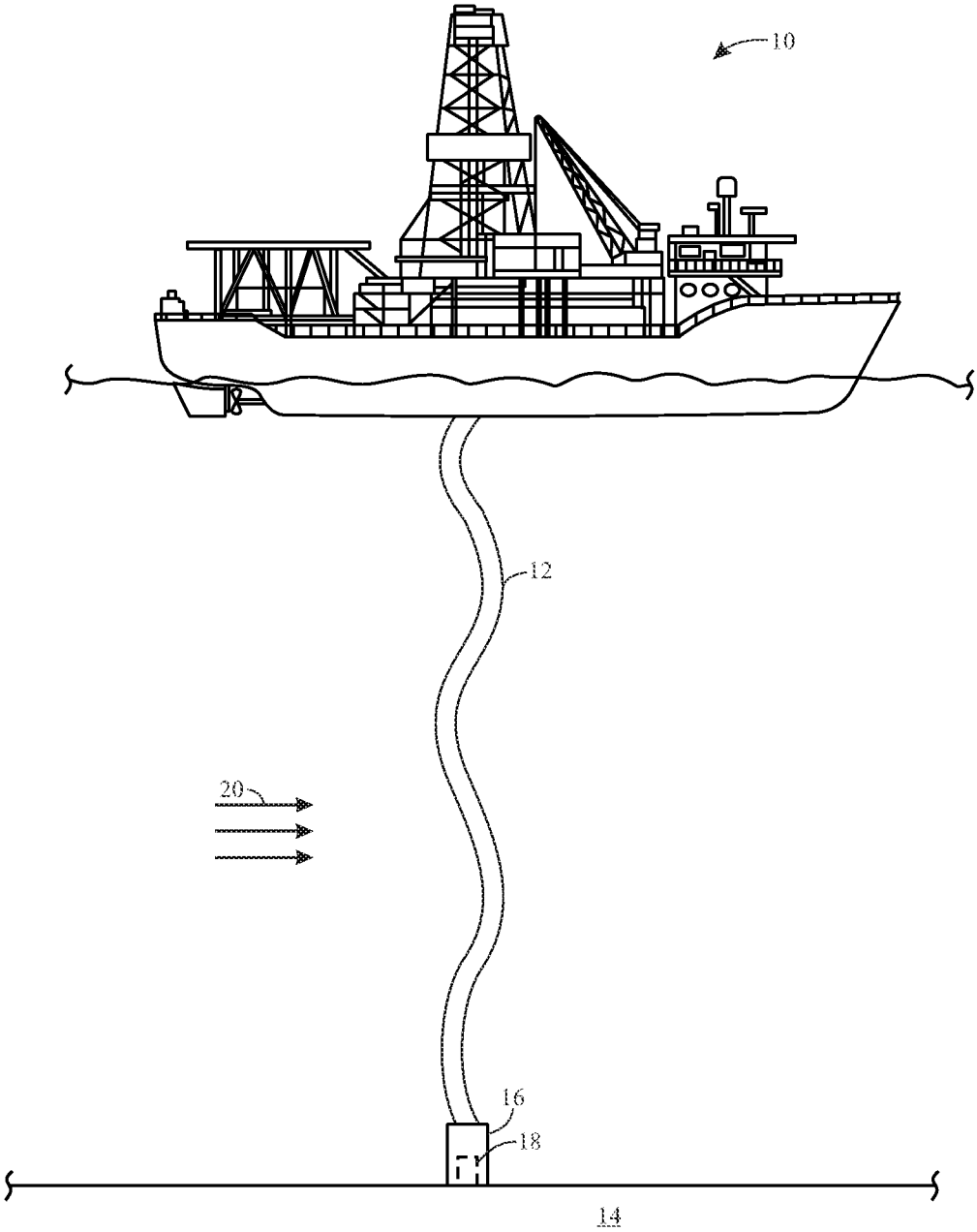
FIG. 2 PRIOR ART
FIG. 2 illustrates an example of the offshore platform of FIG. 1 having a riser experiencing deflection, in accordance with an embodiment.

As illustrated in FIG. 2, the riser 12 may experience deflection, for example, from currents 20. These currents 20 may apply up to and in excess of 100 pounds of force per foot on the riser 12, which causes deflection (e.g., motion, bending, or the like) in riser 12. In some embodiments, this force applied to the riser 12 may cause the riser 12 to contact the edge of the moonpool of the drillship 10. Additionally and/or alternatively, the force applied to the riser 12 from the currents 20 (or other environmental forces) other may cause the riser 12 to stress the BOP 16 or cause key seating, as the angle that the riser 12 contacts the BOP 16 may be affected via the deflection of the riser 12. To reduce the deflection of the riser 12, and to reduce the chances of occurrence of the aforementioned problems caused by riser 12 deflection, one or more systems and techniques may be employed.

Figure 3:
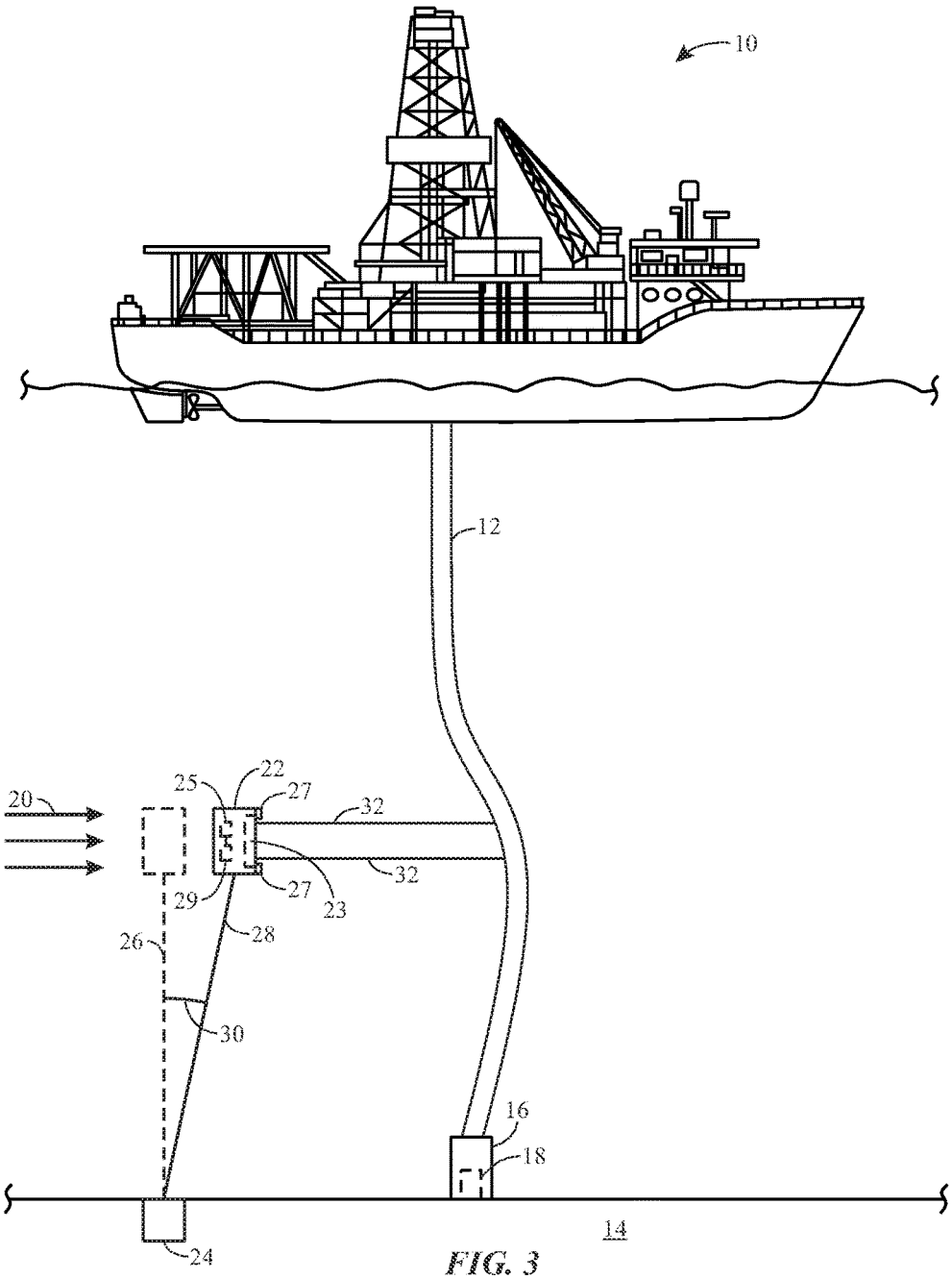
FIG. 3 illustrates a first embodiment of a system to mitigate the deflection of the riser of FIG. 2, in accordance with an embodiment.

FIG. 3 illustrates a first embodiment of a system to mitigate the deflection of the riser 12. In some embodiments, measurements may be made relating to an angle of the riser 12 with respect to the BOP 16 and an angle of the riser with respect to a rig on the drillship 10. Deflection of the riser 12 should be reduced to maintain these angles in a predetermined range to allow for proper operation of the riser 12. To help reduce the deflection, and to maintain the aforementioned angles in a predetermined range, a submersible buoy 22, such as an air can, may be anchored adjacent to (e.g., upstream of) a drilling location (e.g., wellhead 18). In one embodiment, the buoy 22 may be anchored by a suction pile 24 and/or by another anchoring mechanism to the seafloor 14.

The buoy 22 may be coupled to the suction pile 24 via an anchor line 28. In some embodiments, the anchor line 28 may be composed of metal or another minimally deformable material and may allow for only a certain amount of movement from a vertical position 26. For example, currents 20 may apply a force to the buoy 22 that is resisted by the suction pile 24 and anchor line 28 so that movement of the buoy 22 from the vertical position 26 does not exceed a predetermined threshold, as represented by angle 30. This predetermined threshold may be, for example, approximately between 0 degrees and 60 degrees. In other embodiments, the predetermined threshold may be a preset number of degrees per pound of force per foot (e.g., one or two degrees per pound of force per foot applied to the buoy 22 by the currents 20). In other embodiments, the predetermined threshold for movement of the buoy 22 from vertical position 26 may be measured as a linear distance moved by the buoy 22 from the vertical position 26.

The buoy 22 may be tethered to the riser 12 by one or more tethers 32. In one embodiment, each tether 32 may be composed of, for example, nylon rope or a similar material and may allow the buoy 22 to serve as an anchor point for the riser 12, thereby limiting downstream deflections (e.g., limiting the deflection of the riser 12 to the predetermined amount of movement of the buoy 22). In some embodiments, each tether 32 may be adjustable in length. For example, the buoy 22 may include a ratcheting system 23 to extend or retract each tether 32 in response to external forces, such as currents 20. Control of the ratcheting system 23 to extend or retract each tether 32 may be performed internal to the buoy 22, for example, by a controller 25 or may be remotely executed (e.g., from the drillship 10 by a control system therein). Determination of an amount of extension or retraction of each tether 32 may be based on signals received from one or more sensors 27 (e.g., accelerometers, position sensors, or the like) that measure movement of the buoy 22 and/or the riser 12. Accordingly, the sensors 27 may be positioned inside of the buoy 22, on the outer enclosure of the buoy 22, and/or on the riser 12.

In some embodiments, each tether 32 may be extended or retracted by the ratcheting system 23 (in response to signals from the controller 25 and/or the control system of the drillship 10) to compensate for movement of the buoy 22 as sensed by the aforementioned one or more sensors 27. Moreover, each tether 32 may be quickly releasable (from one or both of the riser 12 and the buoy 22) in response to signals from the controller 25 and/or the control system of the drillship 10 such that emergency disconnect of the riser 12 from the wellhead 18 would not be impacted by any tethering of the riser to the buoy 22. Acoustic control or other control mechanisms may also be employed to allow for the quick release of each tether 32.

It should be noted that the controller 25 of the buoy 22 may operate in conjunction with software systems implemented as computer executable instructions stored in a non-transitory machine readable medium 29 such as memory, a hard disk drive, or other short term and/or long term storage). Particularly, the techniques to operate the controller 25 of the buoy 22 may be performed using include code or instructions stored in a non-transitory machine-readable medium 29 (e.g., the memory and/or storage) and may be executed, for example, by one or more processors or the controller 25 of the buoy 22. Accordingly, the controller 25 may be an application specific integrated circuit (ASIC), one or more processors, or another processing device that interacts with one or more tangible, non-transitory, machine-readable media 29 that collectively stores instructions executable by the controller the method and actions described herein. By way of example, such machine-readable media 29 can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by the processor (e.g., controller 25) or by any general purpose or special purpose computer or other machine with a processor. In some embodiments, control of the controller 25 via implementation of code stored in a non-transitory machine-readable medium may be performed on the drillship 10, for example, via a control system that includes an application specific integrated circuit (ASIC), one or more processors, or another processing device that interacts with one or more tangible, non-transitory, machine-readable media to execute software instructions to control controller 25.

Figure 4:
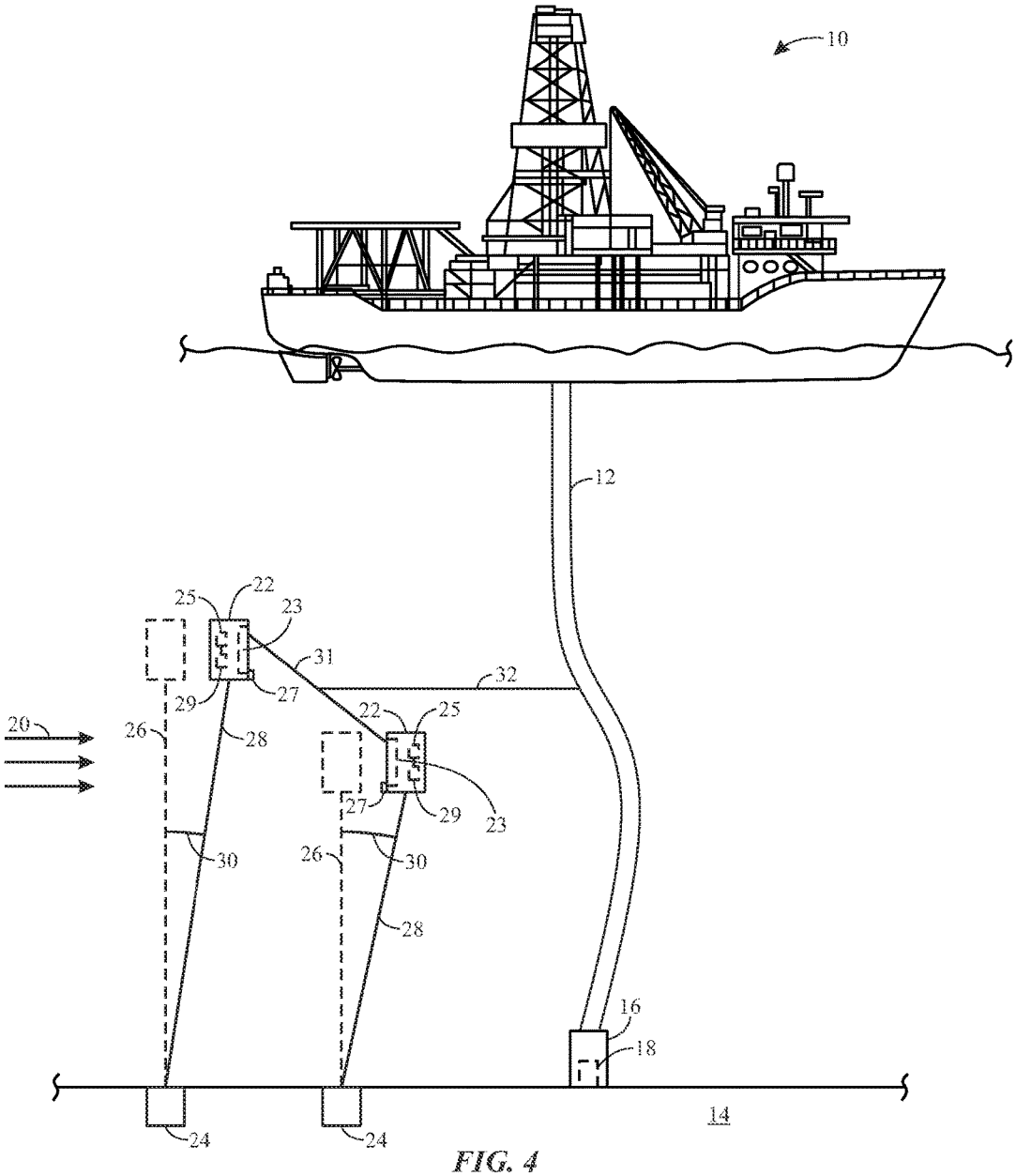
FIG. 4 illustrates a second embodiment of a system to mitigate the deflection of the riser of FIG. 2, in accordance with an embodiment.

FIG. 4 illustrates a second embodiment of a system to mitigate the deflection of the riser 12. As illustrated in FIG. 4, more than one buoy 22 may be employed to anchor riser 12 in a manner similar to that discussed above. For example, one or more tension lines 31 may be coupled between two buoys 22. Tension line 31 may be made of a material similar to that used to form tether 32. Alternatively, tension line 31 may be made of a material similar to that used to form the anchor line 28. One or more tethers 32 may then be coupled to each tension line 31 instead of or in addition to being coupled directly to any of the buoys 22 and the combined resistance of each buoy 22, anchor line 28, and tension line 31 may provide reduced deflection of the riser 12 in a manner similar to that described above with respect to FIG. 3. Moreover, each tether 32 may be quickly releasable (from one or both of the riser 12 and the tension line 31) in response to, for example, signals transmitted from the controller 25 such that emergency disconnect of the riser 12 from the wellhead 18 would not be impacted. Acoustic control or other control mechanisms may also be employed to allow for the quick release of each tether 32. It is noted that the use of multiple buoys 22 with tension lines 31 therebetween allows for the drillship to move from one wellhead 18 in an area to another wellhead 18 in the area while still allowing for the ability to anchor the riser 12 to mitigate deflection caused by, for example, currents 20.

In some embodiments, the suction pile 24 may be a plate anchor, a combination suction pile and plate anchor, or another anchoring mechanism. In some embodiments, suction pile 24 may be lowered to the seafloor 14 while attached to the buoy 22. Alternatively, the buoy 22 can be lowered to a predetermined distance above the suction pile 24 subsequent to the suction pile 24 being anchored in the seafloor 14. Subsequently, the buoy 22 can be tethered to the suction pile 24 via the anchor line 28. In some embodiments, the buoy 22 may include one or more ballast tanks that can be filled with water or air (as required) to alter the buoyancy of the buoy 22 (e.g., to maintain a neutral or slightly above neutral buoyancy) while the buoy 22 is being lowered into its final position (e.g., above suction pile 24) as well when the buoy 22 is in its final position.

In some embodiments, subsequent to the buoy 22 being placed into its final position above the suction pile 24 (e.g., with a neutral or slightly above neutral buoyancy to maintain tension on anchor line 28), a tether 32 may be attached to an eagle eye or other fastener of the buoy 22 for example, by a Remotely Operated Vehicles (ROV). An ROV may be a remotely controllable robot/submersible vessel with that may be controlled from the drillship 10. The ROV may also move to a selected point in the riser 12 that includes an eagle eye or other fastener (welded to the riser 12 or otherwise attached thereto during makeup of the riser 12) and couple the tether 32 to the riser 12. The ROV may alternatively affix a fastener or clamp onto the riser 12 at a particular point and couple the tether 32 thereto. In other embodiments, the tether 32 may already be coupled to the riser 12 (via weld or other fastener) as the riser 12 is being made up and placed into the sea. In this embodiment, the ROV may take the free end of the tether 32 and couple the free end of the tether 32 to the buoy 22.

A similar technique may be utilized in conjunction with installing the tension line 31. For example, tether line 31 may be coupled to two buoys 22 prior to the buoys 22 being placed in their final position, tether line 31 may be coupled to one buoy 22 (e.g., at the surface of the sea) and an ROV may couple a free end of the tether line 31 to another buoy 22 once the buoys 22 are in their final positions, or an ROV may couple a first free end of a tether line 31 to a buoy 22 once the first buoy is in its final position and subsequently couple the other end of the tether line 31 to a second buoy 22 once the second buoy 22 is in its final position. Additionally, the ROV can then couple a tether 32 (which may be affixed to the riser 12 on the drillship 10 or may be affixed to the riser 12 by the ROV when coupled to the seafloor) to the tether line 31. In this manner, the tether 32 may be coupled to the tether line 31.

Figure 5:
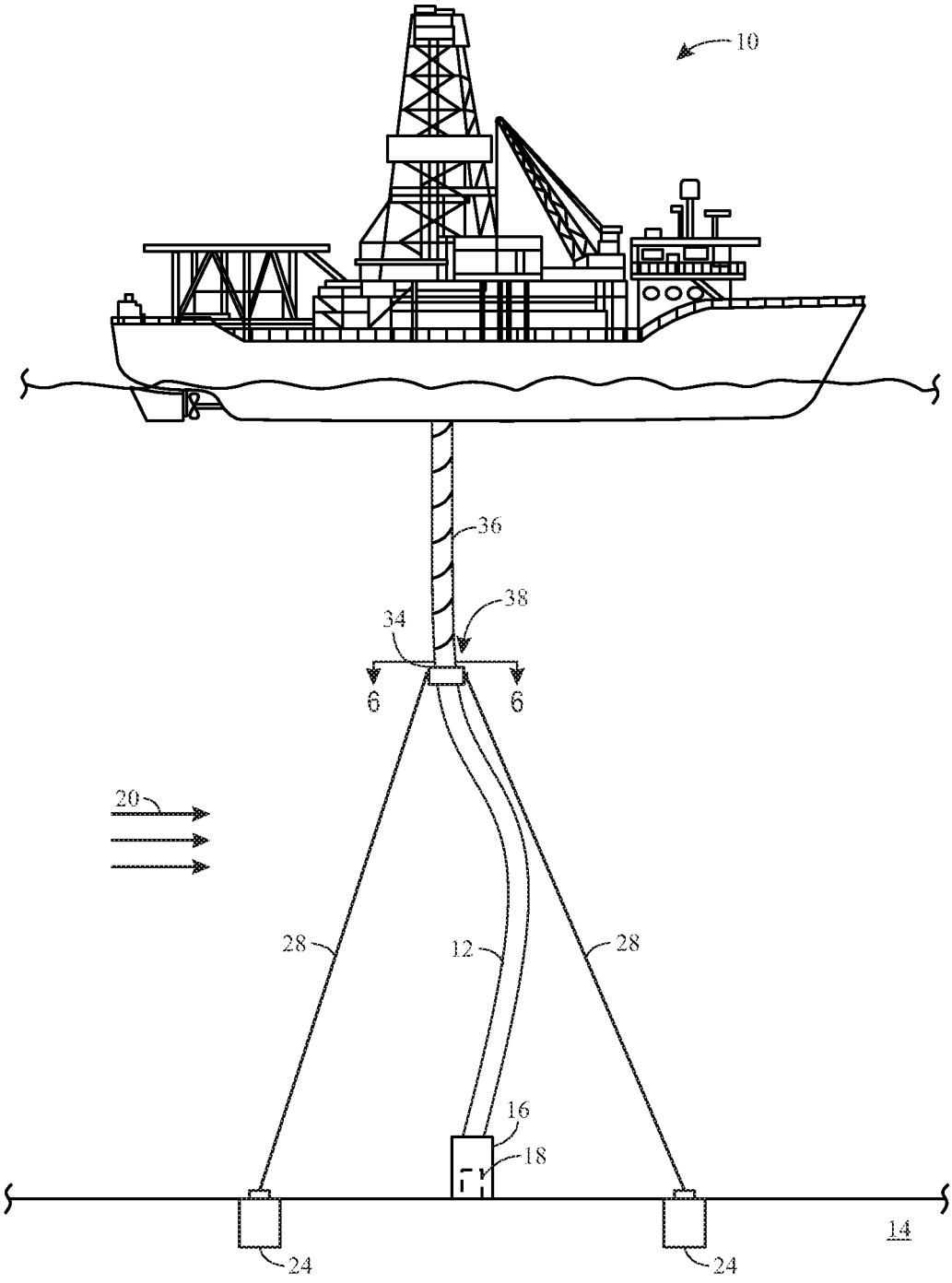
FIG. 5 illustrates a third embodiment of a system to mitigate the deflection of the riser of FIG. 2, in accordance with an embodiment.

FIG. 5 illustrates a third embodiment of a system to mitigate the deflection of the riser 12 that may be used in conjunction with or separate from the techniques outlined above with respect to FIGS. 3 and 4. In some embodiments, measurements may be made relating to an angle of the riser 12 with respect to the BOP 16 and an angle of the riser 12 with respect to a rig on the drillship 10. Deflection of the riser 12 should be reduced to maintain these angles in a predetermined range to allow for proper operation of the riser 12. To help reduce the deflection, and to maintain the aforementioned angles in a predetermined range, a riser restraint device 34 may be utilized to prevent and/or reduce deflection in the riser 12. The riser restraint device 34 may be a ring, cylinder, or similar device that may circumscribe the riser 12. In some embodiments, the riser restraint device 34 may be coupled to a hose 36 or a similar mechanism. The riser restraint device 34 may receive high pressure fluid from the hose 36 and use the high pressure fluid to increase the buoyancy of the riser restraint device 34. The high pressure fluid may be air, nitrogen, or another suitable fluid and may be pressurized up to, for example, approximately 500 pounds per square inch (psi), 1000 psi, 2000 psi, or another value or in a range of approximately 500 psi to 5000 psi. In some embodiments, the hose 36 may be wrapped around or clamped or otherwise affixed to the riser 12 in a helical manner, so as to reduce movement of the riser 12 due to vortex shedding or vortex induced vibration from currents 20.

The riser restraint device 34 may be anchored adjacent to a drilling location (e.g., wellhead 18). In one embodiment, the restraint device 34 may be anchored by one or more suction piles 24 and/or by another anchoring mechanism to the seafloor 14. The riser restraint device 34 may be coupled to the one or more suction piles 24 via respective anchor lines 28. In some embodiments, each anchor line 28 may be composed of metal or another minimally deformable material and may allow for only a certain amount of movement from position 38 in both a vertical and a horizontal direction. In other embodiments, each anchor line 28 may be composed of, for example, nylon rope or a similar material. In operation, for example, currents 20 may apply a force to the riser restraint device 34 that is resisted by the suction piles 24, the anchor lines 28, and the buoyancy of the riser restraint device 34 so that movement of the riser restraint device 34 from position 38 does not exceed a predetermined threshold. In some embodiments, the predetermined threshold may be a preset number of degrees per pound of force per foot (e.g., one or two degrees per pound of force per foot applied to the riser restraint device 34 by the currents 20). In other embodiments, the predetermined threshold for movement of the riser restraint device 34 from position 38 may be measured as a linear distance moved by the riser restraint device 34 from the position 38.

The riser restraint device 34 may serve as a resistance point for the riser 12, thereby limiting downstream deflections (e.g., limiting the deflection of the riser 12 to the predetermined amount of movement of the riser restraint device 34). In some embodiments, each anchor line 28 may be adjustable in length. For example, the riser restraint device 34 may include a ratcheting system or a ratcheting system may be coupled to each suction pile 24 (whereby the ratcheting system is similar to ratcheting system 23 previously described) to extend or retract each anchor line 28 in response to external forces, such as currents 20. Control of the ratcheting system to extend or retract each anchor line 28 may be performed internal to the riser restraint device 34, for example, by a controller therein (e.g., controller 25) or may be remotely executed (e.g., from the drillship 10 by a control system therein) via acoustic signals or other wireless signals or via a hardwired connection. Determination of an amount of extension or retraction of each anchor line 28 may be based on signals received from one or more sensors (e.g., accelerometers, position sensors, or the like similar to sensors 27) that measure movement of the riser restraint device 34 and/or the riser 12. Accordingly, the sensors may be positioned inside of the riser restraint device 34, on the outer enclosure of the riser restraint device 34, and/or on the riser 12. In other embodiments, each anchor line 28 may be of a fixed length, such that no ratcheting system is utilized.

In some embodiments, each anchor line 28 may be quickly releasable (from one or both of the riser restraint device 34 and the suction pile 24) in response to signals from the controller of the riser restraint device 34 and/or in response to signals from the control system of the drillship 10 (e.g., acoustic signals or other wireless signals or via a hardwired connection) such that emergency disconnect of the riser 12 from the wellhead 18 would not be impacted by the tethering of the riser restraint device 34. As noted above, acoustic control or other control mechanisms may be employed to allow for the quick release of each anchor line 28 (e.g., by an independent acoustic release system including a release mechanism at the riser restraint device 34 and/or at the suction piles 24, a receiver and/or transceiver at the riser restraint device 34 and/or at the suction piles 24 to receive signals to initiate a release).

It should be noted that the controller of the riser restraint device 34 (if present) may operate in conjunction with software systems implemented as computer executable instructions stored in a non-transitory machine readable medium (e.g., a non-transitory machine-readable medium 29) of the riser restraint device 34 (such as memory, a hard disk drive, or other short term and/or long term storage). Particularly, the techniques to operate a controller of the riser restraint device 34 may be performed using include code or instructions stored in a non-transitory machine-readable medium of the riser restraint device 34 (e.g., the memory and/or storage) and may be executed, for example, by one or more processors or a controller of the riser restraint device 34. Accordingly, the controller of the riser restraint device 34 may be an application specific integrated circuit (ASIC), one or more processors, or another processing device that interacts with one or more tangible, non-transitory, machine-readable media of the riser restraint device 34 that collectively stores instructions executable by the controller the method and actions described herein. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by the processor e.g., a controller of the riser restraint device 34) or by any general purpose or special purpose computer or other machine with a processor.

In some embodiments, control of a controller of the riser restraint device 34 via implementation of code stored in a non-transitory machine-readable medium may be performed on the drillship 10, for example, via a control system that includes an application specific integrated circuit (ASIC), one or more processors, or another processing device that interacts with one or more tangible, non-transitory, machine-readable media of the drillship 10 to execute software instructions to control a controller of the riser restraint device 34 and/or of suction pile 24.

In some embodiments, the suction pile 24 may be a plate anchor, a combination suction pile and plate anchor, or another anchoring mechanism. In some embodiments, suction pile 24 may be lowered to the seafloor 14 while attached to the riser restraint device 34. Alternatively, the riser restraint device 34 can be lowered to the seafloor 14 around the wellhead 18, for example, prior to installation of the BOP 16 and subsequent to the suction piles 24 being anchored in the seafloor 14. Subsequently, the riser restraint device 34 can be tethered to the suction piles 24 via the anchor lines 28. In some embodiments, the riser restraint device 34 may include one or more ballast tanks that can be filled with water or air (as required) to alter the buoyancy of the riser restraint device 34 (e.g., to maintain a neutral or below neutral buoyancy) while the riser restraint device 34 is being lowered into position (e.g., about wellhead 18). Once the BOP 16 is affixed to the wellhead 18, water may be displaced from the riser restraint device 34 to generate an above neutral buoyancy of the riser restraint device 34 to cause the riser restraint device 34 to float to a predetermined final position (e.g., position 38) above the BOP 16 along the riser 12 at a predetermined height.

In some embodiments, the riser restraint device 34 may have a circumference greater than both the BOP 16 and the riser 12 to allow the riser restraint device 34 to float past the BOP 16 and into its final position (e.g., position 38). In other embodiments, the riser restraint device 34 may have a circumference greater than the riser 12 but less than the BOP 16. Accordingly, the riser restraint device 34 may be transmitted to the seafloor 14 with the BOP 16 and may be tethered to the suction piles 24 via the anchor lines 28 once the BOP 16 is positioned above the wellhead 18. In this embodiment, the anchor lines 28 may be attached to a padeye or other fastener of the riser restraint device 34 for example, by a Remotely Operated Vehicles (ROV). An ROV may be a remotely controllable robot/submersible vessel with that may be controlled from the drillship 10. Once tethered, water may be displaced from the riser restraint device 34 to generate an above neutral buoyancy of the riser restraint device 34 to cause the riser restraint device 34 to float to a predetermined final position (e.g., position 38) above the BOP 16 along the riser 12 at a predetermined height.

In other embodiments, the ROV may also move the riser restraint device 34 to a position above the BOP 16 such that the riser restraint device 34 does not form a ring or other closed shape while being positioned. The ROV may close the riser restraint device 34 to form a closed shape and may use a fastener or locking mechanism to hold the riser restraint device 34 in its closed shape form. Alternatively, the fastener or locking mechanism may automatically engage as the ROV applies pressure to at least two sides of the riser restraint device 34 to enclose the riser restraint device 34 to form a closed shape. Additionally, the ROV may attach the anchor lines 28 to a padeye or other fastener of the riser restraint device 34 and water may be displaced from the riser restraint device 34 to generate an above neutral buoyancy of the riser restraint device 34 to cause the riser restraint device 34 to float to a predetermined final position (e.g., position 38) above the BOP 16 along the riser 12 at a predetermined height. It may be appreciated that the ROV may also tether the anchor lines 28 to the respective suction piles 24. For example, the anchor lines 28 may be attached to a padeye or other fastener such as a ball joint with a fastener that may be part of or attached to the suction piles 24.

Figure 6:
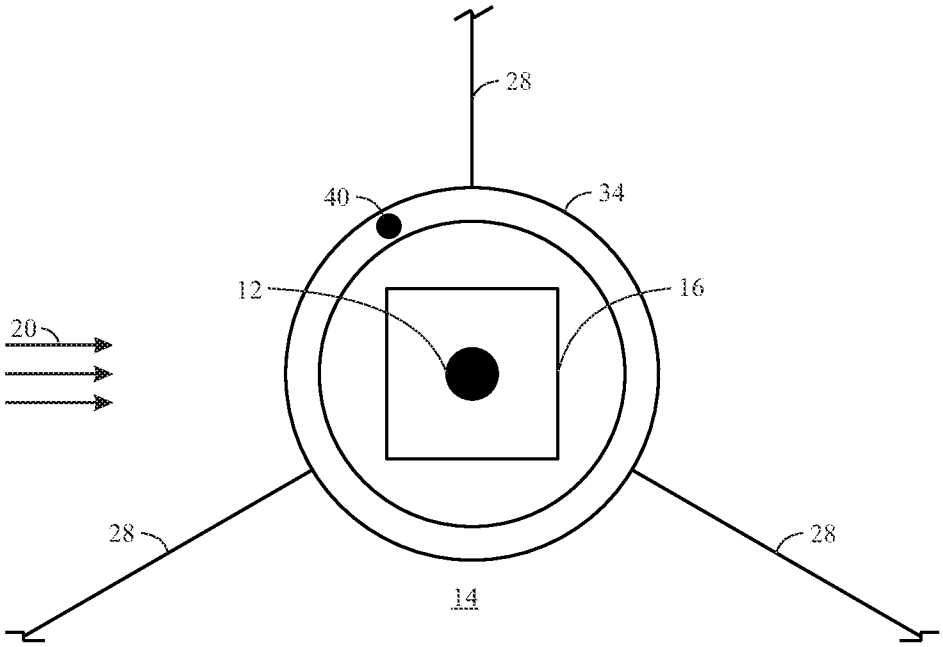
FIG. 6 illustrates a top view of a portion of the system of FIG. 5 identified by arrows 6-6, in accordance with an embodiment.

The riser restraint device 34 is shown in greater detail in FIG. 6. As illustrated, the riser restraint device 34 is tethered to three anchor lines 28 with a distance of approximately 120 degrees between the anchor lines 28. However, it may be appreciated that greater or fewer than three anchor lines 28 may be utilizes to affix the riser restraint device 34 to the seafloor 14. Moreover, the anchor lines 28 may be symmetrically or asymmetrically disposed about the riser restraint device 34. For example, two anchor lines 28 may each be disposed at a distance of approximately 60 degrees from one another and may each be disposed at a distance of approximately 150 degrees from a third anchor line 28. In another embodiment, four anchor lines 28 may be disposed symmetrically about the riser restraint device 34. For example, each of four anchor lines 28 may be disposed at a distance of approximately 90 degrees from one another (e.g., symmetrically about the riser restraint device 34).

In some embodiments, hose 36 may be coupled to the riser restraint device 34 at aperture 40. In some embodiments, aperture 40 may be covered by a valve that may be hydraulically actuated, manually actuated (e.g., by an ROV), acoustically actuated, pressure actuated, electrically actuated, or similarly actuated allow for a predetermined amount of fluid to be transmitted from the hose 36 to the riser restraint device 34. In some embodiments, the riser restraint device 34 may be an open bottom device such that introduction of the fluid from hose 36 forces seawater out from the open bottom of the riser restraint device 34. In other embodiments, the riser restraint device 34 may be a closed device that includes an outlet aperture that may have an outlet valve coupled thereto to allow for release of a fluid in the riser restraint device 34 (e.g., to alter the buoyancy of the riser restraint device 34). The outlet valve may be hydraulically actuated, manually actuated, acoustically actuated, pressure actuated, electrically actuated, or similarly actuated allow for a predetermined amount of fluid to be transmitted from the riser restraint device 34 into the water surrounding the riser restraint device 34.

Figure 7:
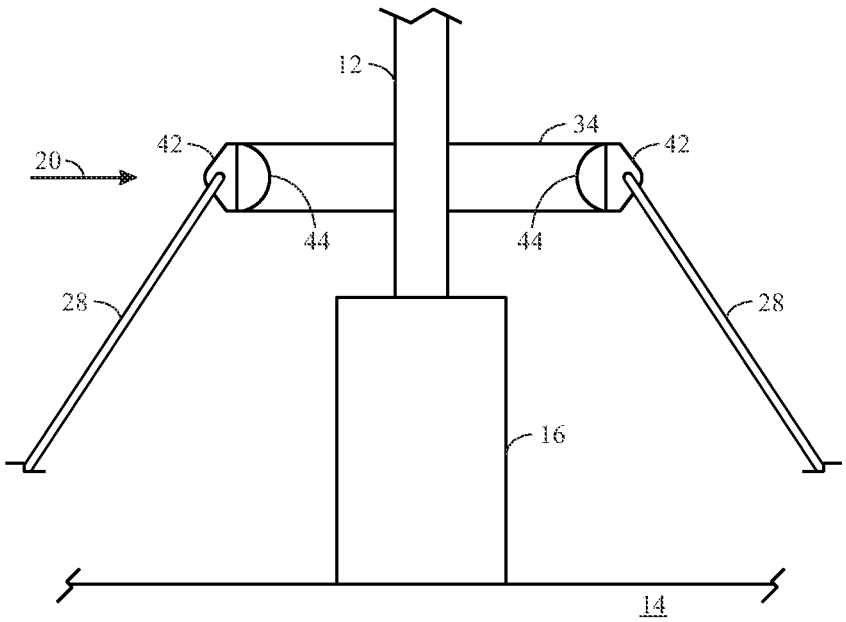
FIG. 7 illustrates a side view of a portion of the system of FIG. 5, in accordance with an embodiment.

FIG. 7 illustrates a side view of the riser restraint device 34 at a position 38 above the BOP 16. As illustrated, the riser restraint device 34 includes separate padeyes 42 that may be coupled to the anchor lines 28. Additionally, cladding 44 is illustrated as being present in the inner circumference of riser restraint device 34. The cladding 44 may be made of a synthetic material, a polymer (e.g., a thermoplastic polymer), or a similar material that may operate to reduce friction between the riser 12 and the riser restraint device 34 and/or cushion any impact between the between the riser 12 and the riser restraint device 34 as the riser 12 moves relative to the riser restraint device 34. In other embodiments, additional cladding material similar to cladding 44 may be placed on the riser 12 at or near position 38 to reduce friction between the riser 12 and the riser restraint device 34 and/or cushion any impact between the between the riser 12 and the riser restraint device 34. Furthermore, cladding material similar to cladding 44 may be affixed to separate joints, such as a pup joint (e.g., drill pipe of a predetermined length used to adjust the length of the drill string/riser) at position 38. In this manner, cladding material may be used in conjunction with standardized risers 12.

Figure 8:
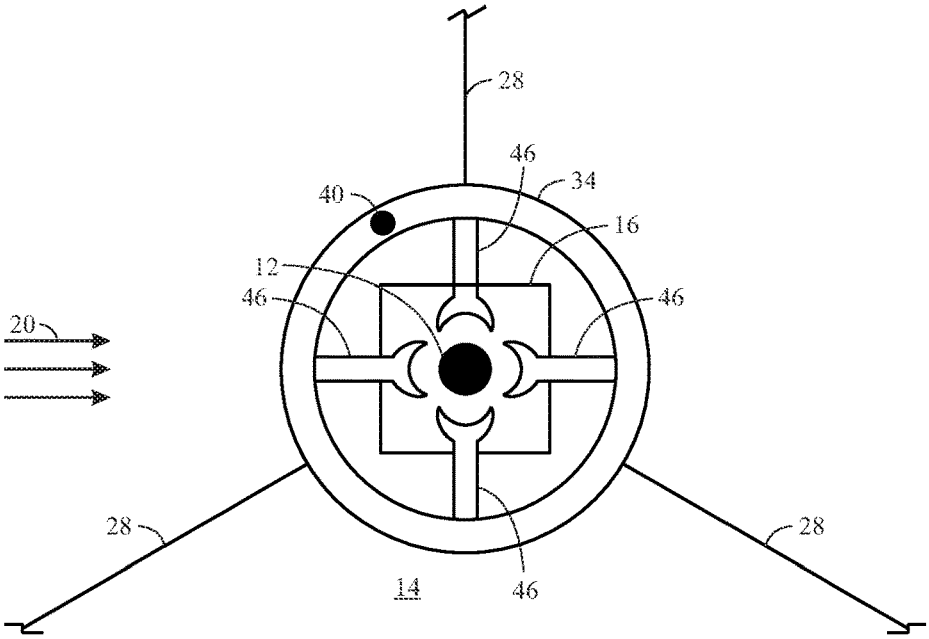
FIG. 8 illustrates a second top view of a portion of the system of FIG. 5 identified by arrows 6-6, in accordance with an embodiment.

FIG. 8 illustrates a top view of a second embodiment of the riser restraint device 34 at a position 38 above the BOP 16. As illustrated, the riser restraint device 34 includes one of more restriction arms 46 that may operate to provide a reduced amount of movement for the riser 12. In one embodiment, the restriction arms 46 may be foldable (e.g., either horizontally or vertically) to allow passage of the BOP 16 through the riser restraint device 34. Additionally, once the riser restraint device 34 is in position 38, the one of more restriction arms 46 may be actuated (e.g., hydraulically, manually, acoustically, via pressure, electrically, or similarly) and may move into the position illustrated in FIG. 8. In some embodiments, the one or more restriction arms 46 may be locked into position automatically or manually. Additionally, the one or more restriction arms 46 may include cladding material similar to cladding 44 on the portion of the arm 46 that extends away from riser restraint device 34 (e.g., the portion of the one or more restriction arms 46 that will contact the riser 12). Additionally, the one or more restriction arms 46 may be disposed symmetrically or asymmetrically about the internal circumference of the riser restraint device 34. Use of the one or more restriction arms 46 may allow for reduced movement of the riser 12 resulting from, for example, currents 20.

In other embodiments, multiple riser restraint devices 34 may be vertically disposed about the riser 12. Each of the riser restraint devices 34 may have separate anchor lines 28 and/or tether lines (e.g., one or more tether lines 31) may be coupled between the anchor line 28 of one riser restraint device 34 and another riser restraint device 34. In other embodiments, the one or more riser restraint devices 34 may be coupled to the riser 12. For example, a padeye or other fastener may be attached (welded to the riser 12 or pup joint or otherwise attached thereto) to allow for a connection point for the anchor lines 28. Attachment of the riser restraint devices 34 may be done during makeup of the riser 12 on the drillship 10 or may be performed by the ROV (e.g., the ROV may alternatively affix a fastener or clamp onto the riser 12 at a particular point).

Determination of the position 38 for one or more riser restraint devices 34 may be aided through the use of measured data. For example, charts may be developed based on measurements of the currents 20 at a particular drill site. These charts, as well as the data contained therein, may be utilized to determine a position 38 for placement of the one or more riser restraint devices 34. Table 1 illustrates an example of such a chart:

TABLE 1

| Depth (ft) | 1 yr | 10 yr |
|---|---|---|
| 0 | 5.3 | 5.9 |
| 164 | 4.3 | 4.7 |
| 328 | 3.8 | 4.2 |
| 459 | 3.3 | 3.6 |
| 755 | 2.0 | 2.2 |
| 1115 | 1.6 | 2.1 |
| 1362 | 1.6 | 2.0 |
| 1788 | 1.2 | 1.3 |
| 2100 | 1.2 | 1.6 |
| 2461 | 1.5 | 2.3 |
| 3002 | 2.0 | 2.2 |
| 3412 | 2.0 | 2.9 |
| 4577 | 0.0 | 0.0 |

Table 1 describes the speed of currents 20 at particular depths over periods of time, for example, one year and ten years. Using this information, a determination of the location (e.g., depth) of the riser restraint device 34 can be made. Once this determination is made, deploying the riser restraint device 34 to a predetermined location (e.g., position 38) may occur. However, it may be appreciated that other information separate from or in addition to the information of Table 1 may be used in determining a location for and/or number of the one or more riser restraint devices 34 used.

Figure 9:
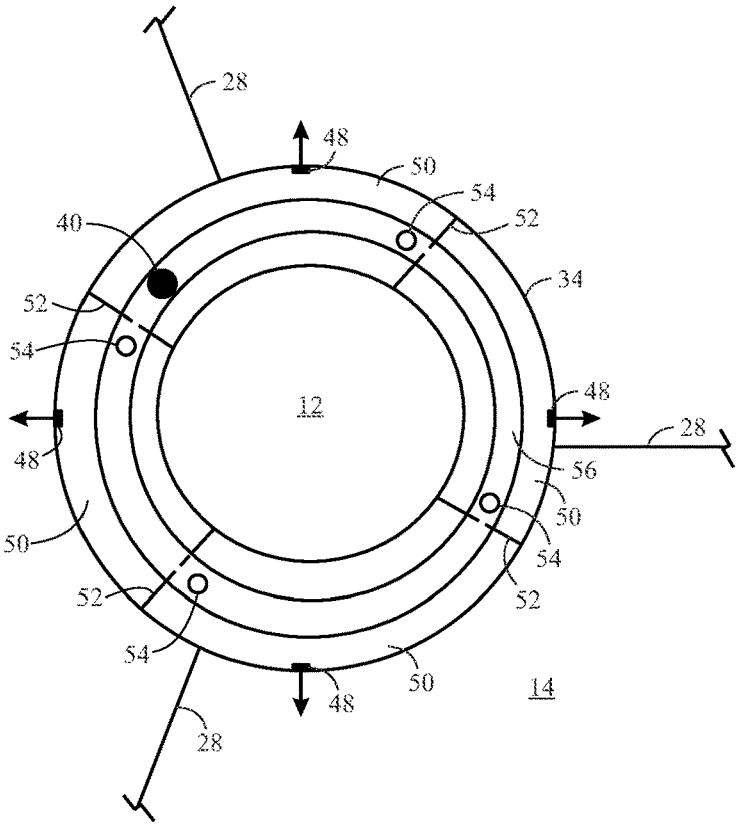
FIG. 9 illustrates a third top view of a portion of the system of FIG. 5 identified by arrows 6-6, in accordance with an embodiment.

FIG. 9 illustrates an additional top view of the riser restraint device 34 that may include outlets 48 that are positioned, for example, every 90 degrees around a circumference of the riser restraint device 34. In one embodiment, separate plenum chambers 50 (fluidly separated from one another by barriers 52) may be present in the riser restraint device 34 or a single plenum chamber may instead be utilized. These plenum chambers 50 may receive the high pressure fluid via one or more valves 54 in a high pressure plenum 56. In some embodiments, high pressure plenum 56 may be circumferentially disposed above the plenum chambers 50 and may be coupled to the hose 36 via the aperture 40 to receive the high pressure fluid. The operation of the valves 54 may be controlled, for example, by a controller of the riser restraint device 34 and/or by a control system of the drillship 10 to allow for the high pressure fluid to be transmitted into a particular plenum chamber 50 for venting of the fluid via respective outlet 48. In other embodiments, the valves 54 may be hydraulically actuated, acoustically actuated, pressure actuated, electrically actuated, or similarly actuated.

In some embodiments, additional valves (e.g., vales adjacent the outlets or outlet valves) in the plenum chambers 50 may control the amount of fluid transmitted from the outlets 48, for example, in response to current conditions detected by sensors and/or based on historical data such that operation of the separate outlets 48 may be controllable to mitigate changing currents 20 (e.g., based on time of day, season, etc.). The operation of the valves that control the amount of fluid transmitted from the outlets 48 may be controlled, for example, by a controller of the riser restraint device 34 and/or by a control system of the drillship 10. In other embodiments, the outlet valves may be hydraulically actuated, acoustically actuated, pressure actuated, electrically actuated, or similarly actuated. Control of these outlet valves of the riser restraint device 34 may ensure that the angles of the riser 12 with respect to the drillship 10 and/or the BOP 16 remain within tolerance levels.

Furthermore, with respect to the outlets 48, it is envisioned that multiple outlets 48 may exist in each plenum chamber 50. For example, multiple outlets 48 may be arranged vertically along the plenum chamber 50 and may extend along a length of the plenum chamber 50. Alternatively, one outlet 48 (e.g., disposed as a slit or other aperture) may extend vertically along the plenum chamber 50 and may extend along a length of the plenum chamber 50. It is envisioned that the number, size, arrangement, and distance that the one or more outlets 48 occupy may be, for example, a function of the surface area of the riser restraint device 34 and the desired strength of the flow exiting the riser restraint device 34. It should be noted that the outlets 48 and associated features of FIG. 9 may be utilized with each of the systems described above in FIGS. 5-9. In this manner, outlets 48 may operate as jets in conjunction with each anchor line 28 to reduce movement of the riser restraint device 34 and, by extension, reduce deflection of the riser 12.

This written description uses examples to disclose the above description, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Accordingly, while the above disclosed embodiments may be susceptible to various modifications and alternative forms, specific embodiments have been shown by way of example in the drawings and have been described in detail herein. However, it should be understood that the embodiments are not intended to be limited to the particular forms disclosed. Rather, the disclosed embodiment are to cover all modifications, equivalents, and alternatives falling within the spirit and scope of the embodiments as defined by the following appended claims.

What is claimed is:

1. A system, comprising:

an anchor configured to be disposed on a seafloor;

an anchor line having a first end and a second end, wherein when the system is in operation, the first end is coupled to the anchor;

a riser restraint device, wherein when the system is in operation, the riser restraint device is coupled to the second end of the anchor line;

a ratcheting system at least partially internal to the riser restraint device; and a tether, wherein when the system is in operation, the tether is coupled to a riser of an offshore vessel and the ratcheting system to indirectly connect the riser to the anchor through the tether, the riser restraint device, and the anchor line to permit the riser restraint device to resist movement of the riser due to a current, wherein the ratcheting system is configured to adjust an amount of the tether extending from the ratcheting system.

2. The system of claim 1, wherein the anchor comprises a suction pile.

3. The system of claim 1, comprising a tether line, wherein when the system is in operation, the tether line is coupled between the riser restraint device and the tether to couple the tether to the riser.

4. The system of claim 1, comprising:

a second anchor configured to be disposed on the seafloor;

a second anchor line, wherein when the system is in operation, the second anchor line is coupled to the second anchor; and a second riser restraint device, wherein when the system is in operation, the second riser restraint device is coupled to the second anchor line and the tether.

5. The system of claim 4, comprising a tether line, wherein when the system is in operation, the tether line is coupled between the tether and the riser to couple tether to the riser.

6. The system of claim 1, wherein the riser restraint device is configured to resist movement of the riser of the offshore vessel at least in part due to the anchor line.

7. A method, comprising:

disposing an anchor on a seafloor;

coupling an anchor line to the anchor;

coupling the anchor line to a riser restraint device;

coupling a tether to a riser of an offshore vessel;

coupling the tether to the riser restraint device or coupling the tether to a tether line coupled to the riser restraint device, wherein the riser restraint device when in operation resists movement of the riser from a current at least in part due to the anchor line indirectly connected to the riser through the tether and the riser restraint device; and extending the tether from the riser restraint device via a ratcheting system at least partially internal to the riser restraint device or retracting the tether into the riser restraint device via the ratcheting system at least partially internal to the riser restraint device when the tether is coupled to the riser restraint device to resist the movement of the riser from the current or extending the tether line from the riser restraint device via a ratcheting system internal to the riser restraint device or retracting the tether line into the riser restraint device via the ratcheting system internal to the riser restraint device when the tether line is coupled to the riser restraint device to resist the movement of the riser from the current.

8. The method of claim 7, comprising determining a location at which to dispose the riser restraint device relative to the seafloor.

9. The method of claim 8, comprising determining the location based upon a respective speed of the current at a respective depth from the offshore vessel.

10. The method of claim 8, comprising transmitting pressurized fluid to the riser restraint device to adjust a buoyancy of the riser restraint device.

11. A system, comprising:

a riser restraint device, wherein when the system is in operation, the riser restraint device resists movement of a riser of an offshore vessel relative to the riser restraint device;

a ratcheting system at least partially internal to the riser restraint device, wherein the ratcheting system is configured to adjust an amount of a tether extending from the ratcheting system to resist the movement of the riser relative to the riser restraint device; and a line, wherein when the system is in operation, the line is coupled to the riser restraint device to anchor the riser restraint device to a seafloor and restrict movement of the riser restraint device.

12. The system of claim 11, wherein the ratcheting system is configured to extend or retract the tether to adjust the amount of the tether between the riser restraint device and the riser.

13. The system of claim 11, comprising a controller configured to control operation of the ratcheting system.

14. The system of claim 13, wherein the controller is configured to control operation of the ratcheting system based upon sensed external forces affecting the riser restraint device, sensed external forces affecting the riser, sensed movement of the riser restraint device, or sensed movement of the riser.

15. The system of claim 11, comprising a second tether configured to be coupled to the riser and to the tether, wherein the ratcheting system is configured to retract the tether to adjust the amount of the tether extending from the ratcheting system between the riser restraint device and a second riser restraint device to increase a resistance provided via the tether and the second tether to resist the movement of the riser relative to the riser restraint device.

* * * * *